US009370282B1

(12) United States Patent
Petersen et al.

(10) Patent No.: US 9,370,282 B1
(45) Date of Patent: Jun. 21, 2016

(54) BATH BRUSH WITH RETRACTABLE HANDLE

(71) Applicant: Paris Presents Incorporated, Gurnee, IL (US)

(72) Inventors: Erik Petersen, Grayslake, IL (US); Stacy Alycia Thomas Castro, Chicago, IL (US)

(73) Assignee: Paris Presents Incorporated, Gurnee, IL (US)

( * ) Notice: Subject to any disclaimer, the term of this patent is extended or adjusted under 35 U.S.C. 154(b) by 0 days.

(21) Appl. No.: 14/805,824

(22) Filed: Jul. 22, 2015

(51) Int. Cl.
*B25G 1/04* (2006.01)
*A47K 7/02* (2006.01)
*A46B 5/00* (2006.01)

(52) U.S. Cl.
CPC ..... *A47K 7/028* (2013.01); *A46B 5/005* (2013.01); *B25G 1/04* (2013.01)

(58) Field of Classification Search
CPC ..... A47K 7/028; A45B 5/005; B25G 1/04
See application file for complete search history.

(56) References Cited

U.S. PATENT DOCUMENTS 7,219,386 B2 * 5/2007 Tsuchiya ..... A47L 13/20 15/144.4
7,802,340 B2 * 9/2010 Knopow ..... A47L 13/24 15/144.1

* cited by examiner

*Primary Examiner* — Shay Karls
(74) *Attorney, Agent, or Firm* — The Ollila Law Group LLC

(57) ABSTRACT

A bath brush includes a brush element, having an elongated arm and a brush head. The elongated arm has a longitudinal groove formed in a first side of said arm and a locking device formed on a second side opposite the first side. The brush handle provides a hollow cavity for receiving the arm therein and includes a rib configured to be received in the longitudinal groove formed on the arm. At least one recess or opening is provided on the handle for receiving the locking device therein. The arm is convertible between an extended position and a retracted position. The locking device and the recesses and/or openings formed on the brush arm and handle, respectively, g are configured to cooperatingly engage and selectively lock the brush's arm within the handle in both the retracted position and the extended position.

12 Claims, 5 Drawing Sheets

BATH BRUSH WITH RETRACTABLE HANDLE

FIELD OF THE INVENTION

The present invention generally relates to a personal cleaning device. More specifically, the present invention relates to a bath brush having a retractable handle with a locking mechanism that enables the length of the brush handle to be varied and the handle portion to be locked securely in place.

BACKGROUND OF THE INVENTION

Bath brushes have been used to wash the human body for hundreds of years. The standard bath brush consists of a plurality of bristles affixed to a compact brush head. Such brushes are designed for a person to wash portions of the body that are easy to reach, but they are difficult to use for washing other body areas, like the back. Moreover, people who have limited mobility due to arthritis, stiffness, or other physical problems, sometimes have difficulty using these bath brushes to wash their feet, shoulders, or lower legs. As a result, back brushes were developed, which typically include a brush secured to an elongated handle. While the elongated handle provides a greater reach to the bather, its length can result in further problems.

For example, back brushes having elongated handles are not suitable for using in washing "close" body parts, for example, the bather's arm, which are generally easy to wash using a standard bath brush. When using a back brush with an elongated handle for cleaning body areas that are near, the user must either hold the handle normally and stretch out the area to be washed, which is uncomfortable, or else choke up on the handle, which makes manipulation of the brush difficult. Some bathers therefore use two different brushes: a standard brush suitable for reaching nearby body areas, and a back brush for reaching more remote areas. Using two different brushes, however, not only exacerbates the problem of packing the brushes, it also clutters the bather's bathtub or shower.

A further problem associated with standard back brushes having elongated handles is that more space is required for storage or transporting the brush, for instance, when traveling, than with standard bath brushes. While it would be desirable to bring a back brush when traveling, the elongated handle would require a larger suitcase or bag.

The prior art has attempted to address the disadvantages associated with standard back brush by developing a single bath brush that combines the most advantageous features of a standard bath brush and back brush.

For example, U.S. 20100011525 discloses a collapsible bath brush with a telescoping handle having several segments that can be extended from or retracted into the brush head. When the handle is retracted into the brush head, the brush is functional as a compact, standard bath brush; when the handle is extended, the brush is functional as a long-handled back brush. The telescoping handle is made up of three segments having cooperating protrusions and indentations. However, the telescoping handle with multiple segments can be difficult to manipulate and it is difficult to lock the segments easily and securely into place during use or storage of the brush.

Further prior art bath brushes provide a hinged handle, allowing the brush to be stored more compactly. Such hinged handles, however, have a number of disadvantages. A person's skin might be pinched in the hinge, and it is often difficult to lock a hinge into a fixed position without requiring additional components.

Therefore, there is a need for a personal bath brush that allows the length of the brush handle to be varied and locked securely into position without multiple components.

SUMMARY OF THE INVENTION

A personal grooming brush includes a brush element, having an elongated arm and a brush head. The elongated arm has a longitudinal groove formed in a first side of said arm and a locking device formed on a second side opposite the first side. The brush handle provides a hollow cavity for receiving the arm therein and includes a rib configured to be received in the longitudinal groove formed on the arm. At least one recess or opening is provided on the handle for receiving the locking device therein. The arm is convertible between an extended position and a retracted position. The locking device and the recesses and/or openings formed on the brush arm and handle, respectively, g are configured to cooperatingly engage and selectively lock the brush's arm within the handle in both the retracted position and the extended position.

ASPECTS OF THE INVENTION

In one aspect of the invention, a personal grooming brush comprises: a brush element, said brush element including an elongated arm and a brush head, wherein said elongated arm includes a longitudinal groove formed in a first side of said arm and a locking device formed on a second side of said arm opposite said first side; a handle, said handle having a hollow cavity for receiving said arm therein, a rib configured to be received in said longitudinal groove on said arm, and at least one recess or opening for receiving said locking device therein, wherein said art is convertible between an extended position and a retracted position, and wherein said locking device and said at least one recess or opening are configured to cooperatingly engage and selectively lock said brush arm in said handle in both the retracted position and the extended position.

Preferably, in the retracted position, the arm is substantially accommodated within said hollow cavity.

Preferably, the locking device comprises at least one of a resilient pin and resilient detent portion.

Preferably, the handle comprises a first handle portion and a second handle portion fixed thereto.

Preferably, the at least one recess or opening for receiving said locking device is formed in said first handle portion.

Preferably, the rib is formed on said second handle portion.

Preferably, the at least one recess for receiving the locking device comprises a longitudinal groove and a broadened recessed portion formed in an interior surface of said handle.

Preferably, the at least one recess comprises a longitudinal groove and a broadened recessed portion formed in said first handle portion.

DETAILED DESCRIPTION OF THE PREFERRED EMBODIMENTS

Figure 1:
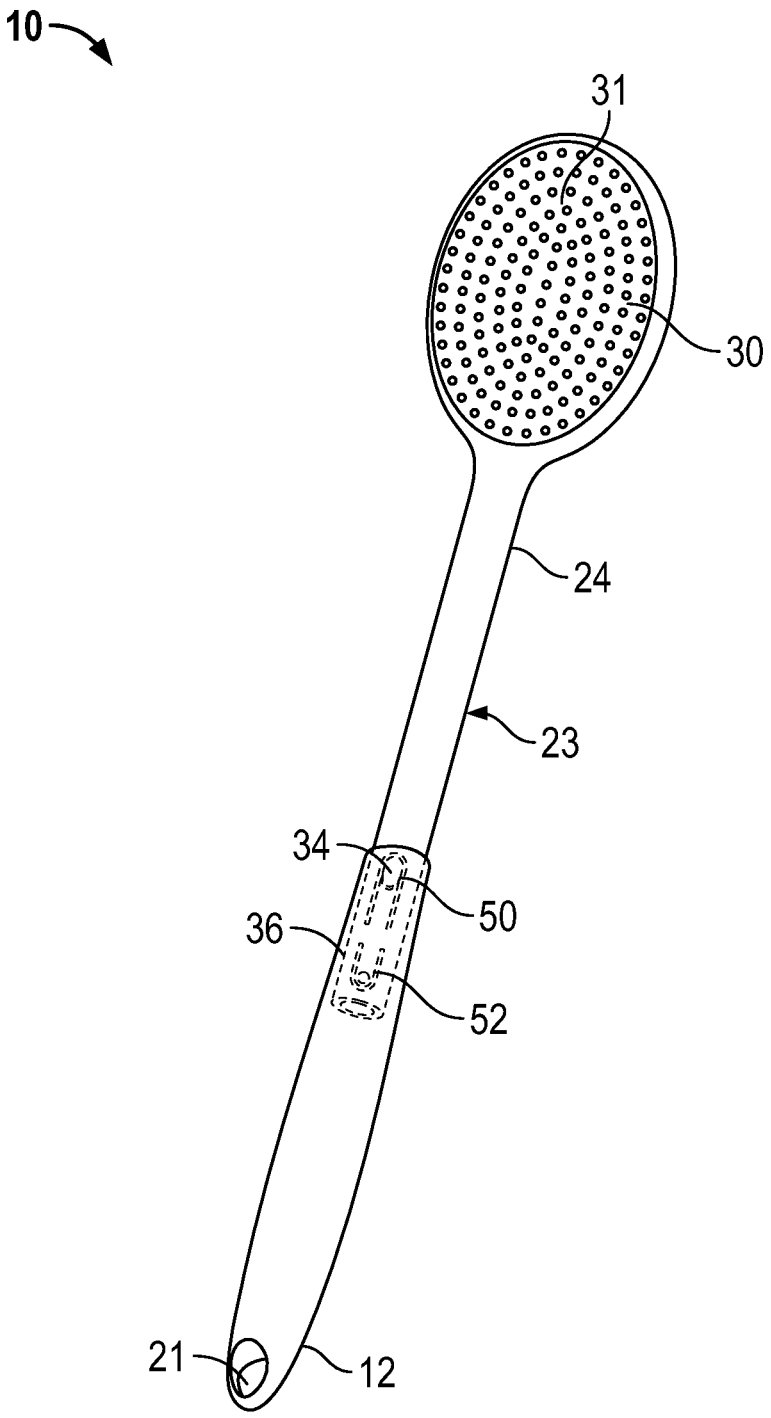
FIG. 1 is a perspective view of a preferred embodiment of the brush according to the invention with the brush in a retracted configuration.
Figure 2:
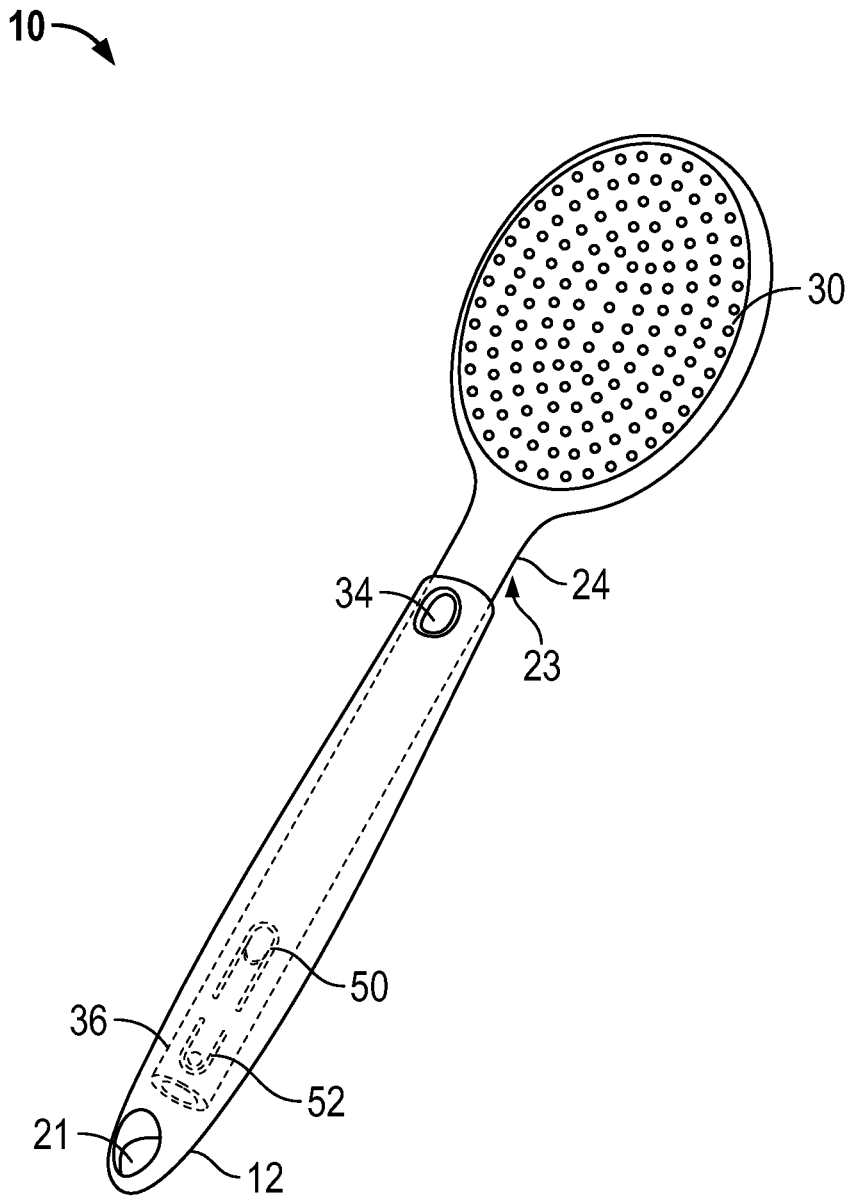
FIG. 2 is a perspective view of the brush of FIG. 1 in a retracted configuration.
Figure 3:
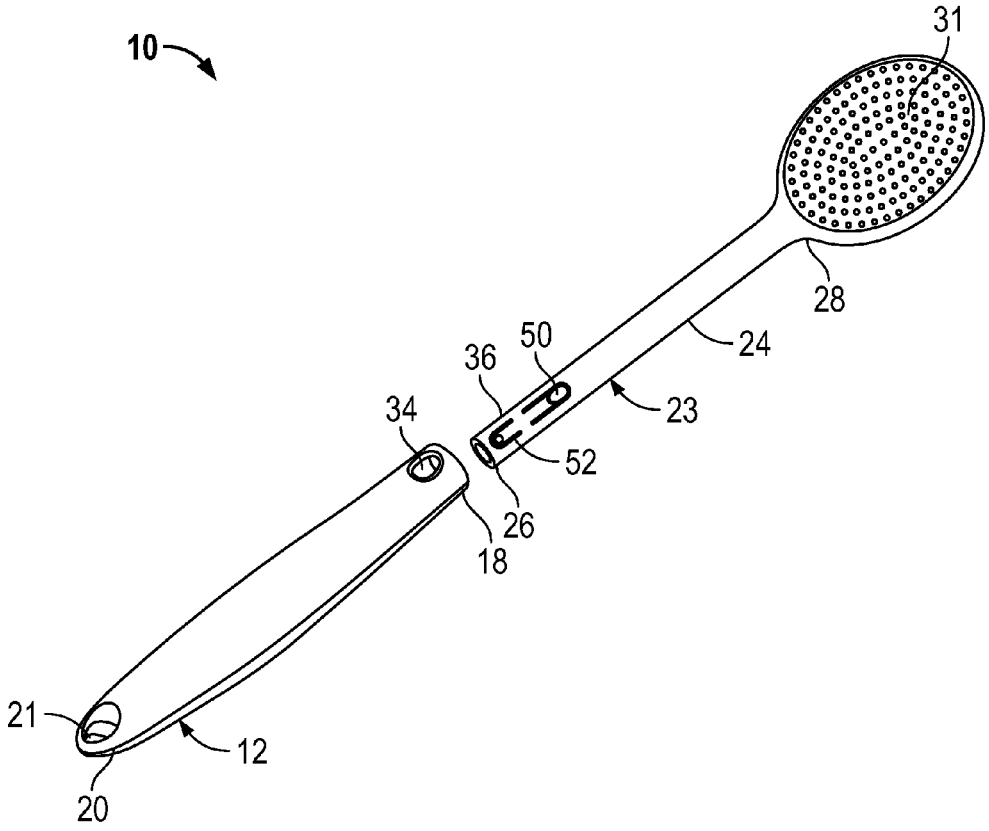
FIG. 3 is an exploded view of the brush in a disassembled configuration.

With reference to FIGS. 1, 2 and 3, the retractable brush 10 of the present invention includes a brush element 23 having a brush arm 24 and a brush head 30 and a hollow handle 12 for receiving the brush arm 24 therein. The brush arm 24 is movable between an extended position, as shown in FIG. 1 and a retracted position, in which it is contained within the interior of the handle 12, as shown in FIG. 2. A locking mechanism 36 is provided for securing the brush arm 24 in both its extended and retracted positions.

Figure 4:
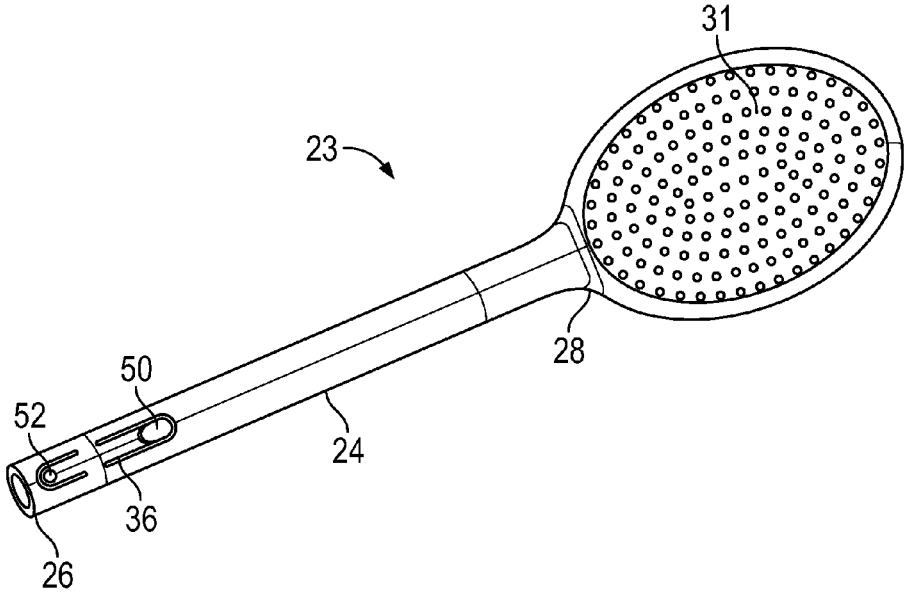
FIG. 4 is a perspective view of the front of the brush arm of FIGS. 1-3.
Figure 5:
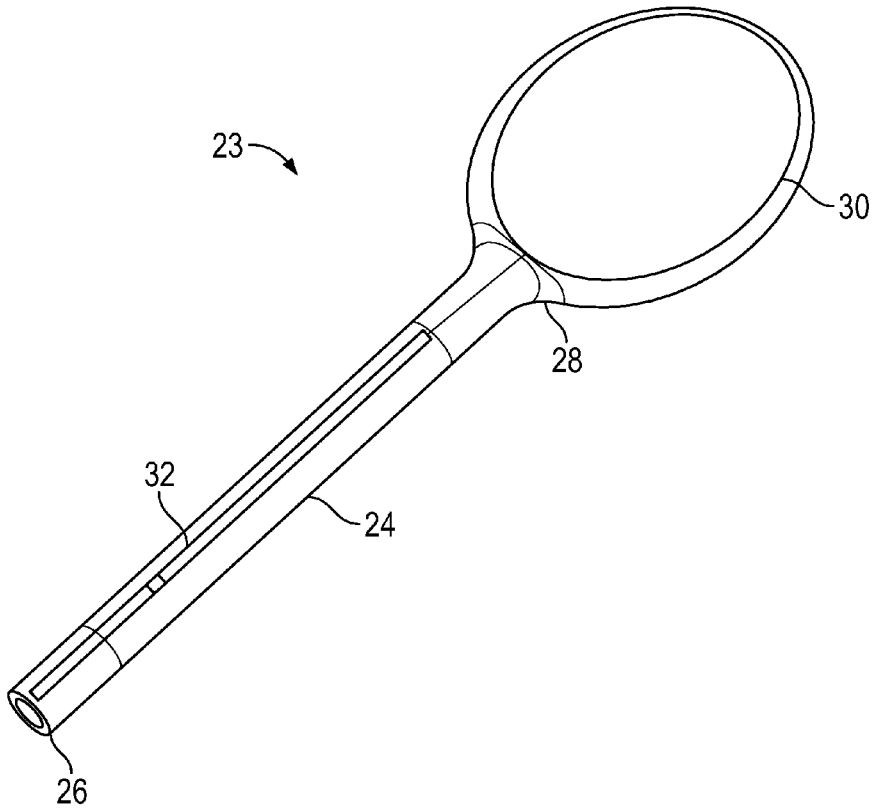
FIG. 5 is a perspective view of the back of the brush arm of FIGS. 1-3.

As shown in FIGS. 4 and 5, the brush element 23 includes a brush arm 24 having a first, open end 26 and a second end 28, a brush head 30 having a plurality of bristles 31 substantially covering one side of the brush head 30 and disposed at the second end 38 of the brush arm 24, a locking mechanism 36 disposed on the front side of the brush arm 24 proximate the first, open end 26 of the brush arm 24, and a longitudinal groove 32 disposed on the back side of the brush arm 24 for receiving a cooperating rib 42 on the interior of the handle 12, as will be described below. The locking mechanism includes profiled resilient detent and pin elements 50, 52, respectively, which cooperate with recesses formed in the handle 12 for locking the brush arm 24 into position within the handle 12, as will be described below.

Figure 6:
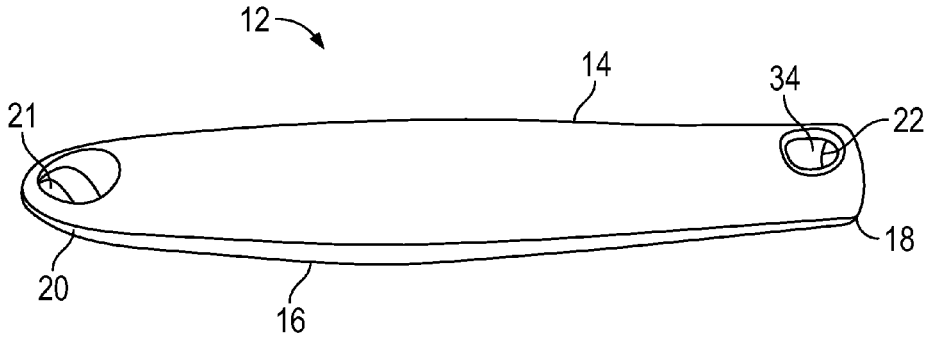
FIG. 6 is a perspective view of the handle portion.

As shown in FIG. 6, the handle 12 has a first open end 18 and a second, base end 20. The handle 12 is formed from a first arcuate handle portion 14 and a second arcuate handle portion 16, which are connected (for example, via sonic welding) to form the handle 12. The handle 12 has a hollow cavity 22 for receiving the brush arm 24. The first handle portion 14 has a first longitudinal end 60 and second longitudinal end 62, with an opening 40 disposed at the first longitudinal end 60. The second handle portion 16 has a first longitudinal end 70 and second longitudinal end 72, with an opening 44 disposed at first longitudinal end 70. When the first handle portion 14 and second handle portion 16 are connected to form the handle 12, openings 40, 44 are aligned to form a through-hole 21 in the handle's base end 20, which can be used for hanging up or storing the brush 10 when not in use.

Figure 7A:
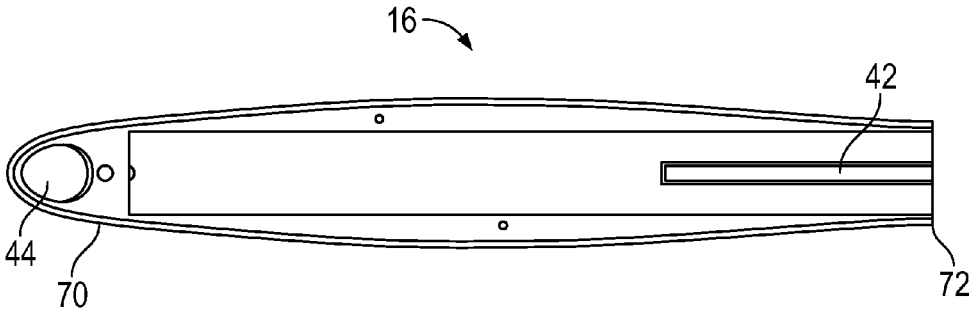
FIGS. 7A and 7B show perspective view of first and second handle portions that form the handle.

Looking now at FIG. 7A, the second handle portion 16 is provided with a rib 42, which extends partially along the length of the second handle portion 16 from the second end 72 of the second handle portion 16 toward the first end 70 of the second handle portion 70. When the brush arm 24 is slid into the open end 18 of the handle 12, the rib 42 engages in the groove 32 provided on the back of the brush arm 24 and assists in guiding the brush arm 24 into the hollow cavity 22 formed within the handle 12 and fixing the brush arm 24 into position. As shown in the figures, the groove 32 and the rib 42 extend only partially along the length of the brush arm 24 and second handle portion 16. This feature allows the rib 42 to "bottom out" in the groove 32 when the brush arm 24 is at full extension, so that the brush arm 24 cannot be fully removed from the handle.

Figure 7B:
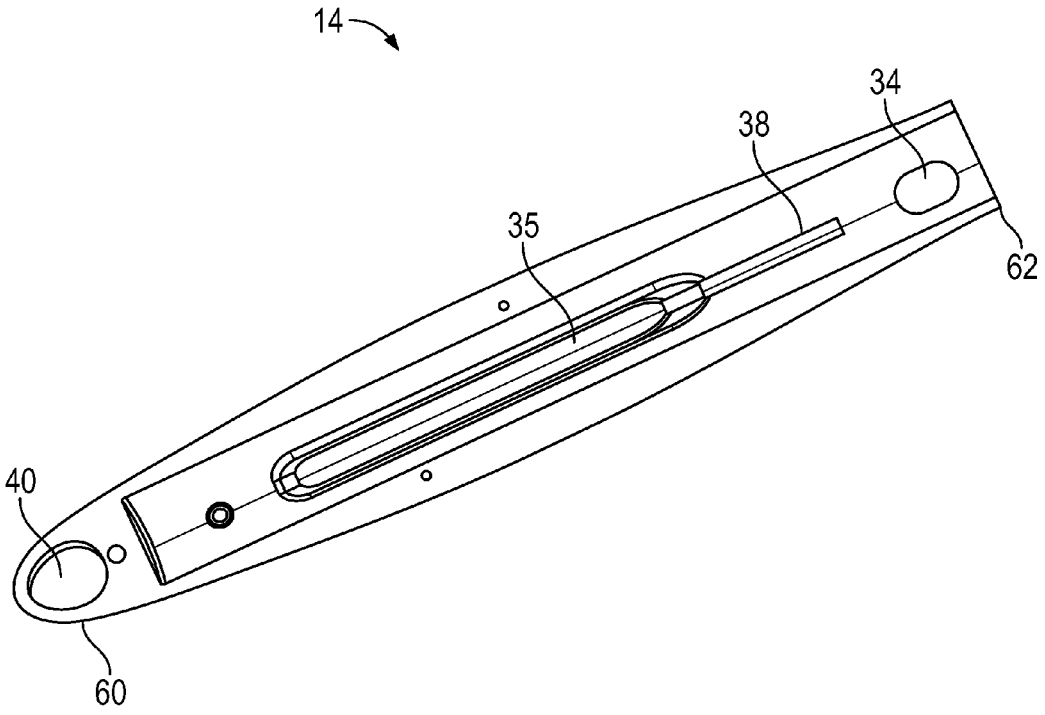

FIG. 7B shows the first handle portion 14, which includes a detent recess 34 disposed at the second longitudinal end 62. A longitudinal groove 38 extends partially along the length of the first handle portion 14 from the second end 62 toward the first end 60 of the first handle portion 14. The longitudinal groove 38 widens to form an elongated recessed portion 35.

FIG. 3 shows the brush 10 in a disassembled state. In use, when the brush arm 24 is slid partially into the open end 18 of the handle 12, the resilient pin element 5 of the locking mechanism 36 engages within the longitudinal groove 38 and detent element 50 engages within the detent recess 34, thereby locking the brush arm 24 into its extended position shown in FIG. 1. When it is desired to use the brush 10 with a shorter configuration or to store the brush 10 in a space-saving manner, the brush arm 24 is slid into the open end 18 of the handle 12, so that the end 26 of the brush arm 24 is moved through the length of the hollow cavity 22 toward the base end 21 of the handle. The pin 52 and detent 50 are then moved into engagement with the elongated recessed portion 35 and the longitudinal groove 38, respectively, to lock the brush arm 24 in the retracted position shown in FIG. 2.

The brush element 21 and handle 12 are preferably made from a durable plastic material, such as acrylonitrile butadiene styrene (ABS) or polypropylene. Further, a drainage hole may be provided in the handle portion to allow water within the hollow interior to drain.

The detailed descriptions of the above embodiments are not exhaustive descriptions of all embodiments contemplated by the inventors to be within the scope of the Application. Indeed, persons skilled in the art will recognize that certain elements of the above-described embodiments may variously be combined or eliminated to create further embodiments, and such further embodiments fall within the scope and teachings of the Application. It will also be apparent to those of ordinary skill in the art that the above-described embodiments may be combined in whole or in part to create additional embodiments within the scope and teachings of the Application.

Thus, although specific embodiments of, and examples for, the Application are described herein for illustrative purposes, various equivalent modifications are possible within the scope of the Application, as those skilled in the relevant art will recognize. The teachings provided herein may be applied to other linear cylinders, and not just to the embodiments described above and shown in the accompanying figures. Accordingly, the scope of the Application should be determined from the following claims.

We claim:

1. A bath brush comprising:

a brush element, said brush element including an elongated arm, wherein said elongated arm includes a longitudinal groove formed in a first side of said elongated arm and a springless locking device comprised of resilient detent and pin elements formed into a second side of said elongated arm opposite said first side such that the resilient detent and pin elements are contained into the same piece of material as the elongated arm, and an oval shaped brush head disposed at the second end of the brush arm having a plurality of bristles oriented perpendicular to the elongated arm, the bristles substantially covering one side of the brush head;

a handle, said handle having a hollow cavity for receiving said elongated arm therein, a rib configured to be received in said longitudinal groove on said elongated arm, and at least one recess or opening for receiving said locking device therein, wherein said elongated arm is convertible between an extended position and a retracted position, and wherein said locking device and said at least one recess or opening are configured to cooperatingly engage and selectively lock said elongated arm in said handle in both the retracted position and the extended position.

2. The brush according to claim 1, wherein in said retracted position, said elongated arm is substantially accommodated within said hollow cavity.

3. The brush according to claim 1, wherein the locking device comprises at least one of a resilient pin and resilient detent portion.

4. The brush according to claim 1, wherein the handle comprises a first handle portion and a second handle portion fixed thereto.

5. The brush according to claim 4, wherein the at least one recess or opening for receiving said locking device is formed in said first handle portion.

6. The brush according to claim 1, wherein the at least one recess for receiving the locking device comprises a longitudinal groove and a broadened recessed portion formed in an interior surface of said handle.

7. The brush according to claim 1, wherein the rib is formed on said second handle portion.

8. The brush according to claim 5, wherein the at least one recess comprises a longitudinal groove and a broadened recessed portion formed in said first handle portion.

9. The brush according to claim 1, wherein the longitudinal groove and the rib extend only partially along a longitudinal extension of the elongated arm and handle, respectively.

10. The brush according to claim 9, wherein the longitudinal groove and the rib are configured such that when engaged, the brush element cannot be removed from the handle when the brush element is in the extended position.

11. A bath brush comprising:

a brush element, said brush element including an elongated arm and a brush head, wherein said elongated arm includes a longitudinal groove formed in a first side of said elongated arm and a springless locking device comprised of resilient detent and pin elements formed into a second side of said elongated arm opposite said first side such that the resilient detent and pin elements are contained into the same wee of material as the elongated arm, and a brush head disposed at the second end of the brush arm having a plurality of bristles oriented perpendicular to the elongated arm, the bristles substantially covering one side of the brush head;

a handle, said handle having a hollow cavity for receiving said elongated arm therein, a rib configured to be received in said longitudinal groove on said elongated arm, and at least one recess or opening for receiving said locking device therein, wherein said elongated arm is convertible between an extended position and a retracted position, and wherein said locking device and said at least one recess or opening are configured to cooperatingly engage and selectively lock said elongated arm in said handle in both the retracted position and the extended position, wherein the at least one recess for receiving the locking device comprises a longitudinal groove and a broadened recessed portion formed in an interior surface of said handle; and wherein the longitudinal groove and the rib are configured such that when engaged, the brush element cannot be removed from the handle when the brush element is in the extended position.

12. A bath brush comprising:

a brush element, said brush element including an elongated arm and a brush head, wherein said elongated arm includes a longitudinal groove formed in a first side of said elongated arm and a springless locking device comprised of resilient detent and pin elements formed on a second side of said elongated arm opposite said first side, wherein the brush head is disposed at the second end of the brush arm, having a plurality of bristles oriented perpendicular to the elongated arm, the bristles substantially covering one side of the brush head;

a handle, said handle having a hollow cavity for receiving said elongated arm therein, a rib configured to be received in said longitudinal groove on said elongated arm, and at least one recess or opening for receiving said locking device therein, wherein said elongated arm is convertible between an extended position and a retracted position, and wherein said locking device and said at least one recess or opening are configured to cooperatingly engage and selectively lock said elongated arm in said handle in both the retracted position and the extended position, wherein the at least one recess for receiving the locking device comprises a longitudinal groove and a broadened recessed portion formed in said first handle portion; and wherein the longitudinal groove and the rib are configured such that when engaged, the brush element cannot be removed from the first handle portion when the brush element is in the extended position.

* * * * *